US009631524B2

(12) United States Patent
Sato

(10) Patent No.: US 9,631,524 B2
(45) Date of Patent: Apr. 25, 2017

(54) VALVE TIMING CONTROL APPARATUS OF INTERNAL COMBUSTION ENGINE

(71) Applicant: HITACHI AUTOMOTIVE SYSTEMS, LTD., Ibaraki (JP)

(72) Inventor: Kenji Sato, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 224 days.

(21) Appl. No.: 14/656,063

(22) Filed: Mar. 12, 2015

(65) Prior Publication Data

US 2016/0084120 A1 Mar. 24, 2016

(30) Foreign Application Priority Data

Sep. 22, 2014 (JP) ..... 2014-192077

(51) Int. Cl.
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/34426* (2013.01); *F01L 2001/34453* (2013.01); *F01L 2001/34483* (2013.01)

(58) Field of Classification Search
CPC ... F01L 2001/34423; F01L 2001/34433; F01L 2001/34463; F01L 2001/34466; F01L 2001/34469
USPC ..... 123/90.17
See application file for complete search history.

(56) References Cited

U.S. PATENT DOCUMENTS 8,789,505 B2 7/2014 Watanabe
2013/0146005 A1* 6/2013 Watanabe ..... F01L 1/3442 123/90.15
2013/0180481 A1* 7/2013 Kato ..... F01L 1/34 123/90.15
2013/0233263 A1* 9/2013 Kinouchi ..... F01L 1/3442 123/90.17
2014/0150744 A1* 6/2014 Kakuda ..... F02D 13/0219 123/90.17

FOREIGN PATENT DOCUMENTS

JP 2013-119842 A 6/2013

* cited by examiner

*Primary Examiner* — Jorge Leon, Jr.
(74) *Attorney, Agent, or Firm* — Foley & Lardner LLP

(57) ABSTRACT

In a hydraulically-operated multi-vane equipped valve timing control apparatus of an internal combustion engine, at least one of a plurality of vanes is equipped with a fluid-communication control mechanism FCCM, whereas the other vanes are configured as non-FCCM equipped vanes. At least one of the non-FCCM equipped vanes is configured such that a summed pressure-receiving surface area of the non-FCCM equipped at least one vane, facing a phase-retard chamber, and a summed pressure-receiving surface area of the non-FCCM equipped at least one vane, facing a phase-advance chamber, are set to differ from each other, thereby permitting a vane rotor to be biased in a specified rotation direction by the unbalanced pressure-receiving surface area configuration as well as establishment of fluid-communication between the two adjacent chambers through the fluid-communication control mechanism, when starting the engine from its stopped state where there is no hydraulic-pressure supply from an oil pump.

20 Claims, 10 Drawing Sheets

VALVE TIMING CONTROL APPARATUS OF INTERNAL COMBUSTION ENGINE

TECHNICAL FIELD

The present invention relates to a valve timing control apparatus of an internal combustion engine for variably controlling valve timings (i.e., valve open timing and valve closure timing) of intake and/or exhaust valves depending on engine operating conditions.

BACKGROUND ART

In recent years, there have been proposed and developed various hydraulically-operated vane rotor equipped variable valve timing control (VTC) devices, capable of locking a relative angular phase of a vane rotor (a camshaft) to a housing (an engine crankshaft or a timing sprocket) at a predetermined relative angular phase between a maximum phase-advance position and a maximum phase-retard position by engagement of a lock pin during an engine stopping period, thereby improving a startability of the engine.

One such valve timing control apparatus has been disclosed in Japanese Patent Provisional Publication No. 2013-119842 (hereinafter is referred to as "JP2013-119842"), corresponding to U.S. Pat. No. 8,789,505, issued on Jul. 29, 2014. The valve timing control apparatus disclosed in JP2013-119842 is configured to permit two adjacent hydraulic chambers (that is, a phase-retard hydraulic chamber and a phase-advance hydraulic chamber), arranged circumferentially adjacent to each other and defined on both sides of a vane, to be communicated with each other at a maximum phase-retard position of the vane rotor, prior to locking the vane rotor. This increases a fluttering motion of the vane rotor, caused by positive and negative alternating torque transmitted from the camshaft due to spring forces of valve springs, thereby enabling the vane rotor to be moved to the predetermined relative angular phase (i.e., the lock position) rapidly.

SUMMARY OF THE INVENTION

However, the VTC apparatus as disclosed in JP2013-119842 has the difficulty of rapidly moving the vane rotor toward the predetermined relative angular phase under a low-temperature engine operating condition in which a viscosity of working fluid is high and thus the viscous resistance of working fluid is also high. Owing to such a high viscous resistance of working fluid, it is difficult to ensure a rapid rotary motion of the vane rotor toward the predetermined relative angular phase even after fluid-communication between the previously-discussed two adjacent hydraulic chambers (i.e., the phase-retard hydraulic chamber and the phase-advance hydraulic chamber), arranged circumferentially adjacent to each other, has been established.

It is, therefore, in view of the previously-described drawbacks of the prior art, an object of the invention to provide a valve timing control apparatus of an internal combustion engine, capable of more rapidly moving the vane rotor toward its lock position immediately before the engine has stopped running.

In order to accomplish the aforementioned and other objects of the present invention, a valve timing control apparatus of an internal combustion engine comprises a housing adapted to be driven by torque transmitted from a crankshaft and having a plurality of shoes formed to protrude radially inward from an inner periphery of the housing for partitioning an internal space into a plurality of working chambers, a vane rotor having a rotor configured to rotate relatively to the housing and a plurality of vanes fixedly connected to a camshaft together with the rotor and formed to protrude radially outward from an outer periphery of the rotor for partitioning the working chambers into phase-retard chambers and phase-advance chambers in cooperation with the shoes, a lock mechanism interposed between the vane rotor and the housing for restricting rotary motion of the vane rotor relative to the housing depending on an engine operating condition, and a fluid-communication control mechanism FCCM having a communication hole formed in at least one of the plurality of vanes so as to permit fluid-communication between the phase-retard chamber and the phase-advance chamber defined by the at least one vane through the communication hole, and configured to enable switching between a communication state of the communication hole and a non-communication state of the communication hole, wherein the other vanes except the at least one vane equipped with the fluid-communication control mechanism FCCM are configured so as not to have the fluid-communication control mechanism FCCM, and at least one of the other vanes, each of which is not equipped with the fluid-communication control mechanism FCCM, is configured such that a summed pressure-receiving surface area of the non-FCCM equipped at least one vane, facing the phase-retard chamber, and a summed pressure-receiving surface area of the non-FCCM equipped at least one vane, facing the phase-advance chamber, are set to differ from each other.

According to another aspect of the invention, a valve timing control apparatus of an internal combustion engine comprises a housing adapted to be driven by torque transmitted from a crankshaft and having a plurality of shoes formed to protrude radially inward from an inner periphery of the housing for partitioning an internal space into a plurality of working chambers, a vane rotor having a rotor configured to rotate relatively to the housing and a plurality of vanes fixedly connected to a camshaft together with the rotor and formed to protrude radially outward from an outer periphery of the rotor for partitioning the working chambers into phase-retard chambers and phase-advance chambers in cooperation with the shoes, a housing hole formed in the vane rotor, a lock member slidably accommodated in the housing hole, a lock recessed groove formed in the housing and configured to permit the lock member to be brought into engagement with the lock recessed groove, a biasing member provided to apply a biasing force to the lock member for permanently biasing the lock member toward the lock recessed groove, a lock mechanism passage configured to supply hydraulic pressure to the lock member for movement of the lock member out of engagement with the lock recessed groove, and a fluid-communication control mechanism FCCM provided in at least one of the plurality of vanes and configured to enable switching between a fluid-communication established state and a fluid-communication blocked state of the phase-retard chamber and the phase-advance chamber defined by the at least one vane equipped with the fluid-communication control mechanism FCCM, wherein the other vanes except the at least one vane equipped with the fluid-communication control mechanism FCCM are configured so as not to have the fluid-communication control mechanism FCCM, and at least one of the other vanes, each of which is not equipped with the fluid-communication control mechanism FCCM, is configured such that a summed pressure-receiving surface area of the non-FCCM equipped at least one vane, facing the phase-retard chamber, and a summed pressure-receiving surface area of the non-FCCM equipped at least one vane, facing the phase-advance chamber, are set to differ from each other.

The other objects and features of this invention will become understood from the following description with reference to the accompanying drawings.

BRIEF DESCRIPTION OF THE DRAWINGS

FIG. 6A is a lateral cross-sectional view taken along the line A-A of FIG. 2 under a maximum vane-rotor phase-retard state, whereas

FIG. 7A is a lateral cross-sectional view taken along the line A-A of FIG. 2 under a vane-rotor lock state, whereas

FIG. 8A is a lateral cross-sectional view taken along the line A-A of FIG. 2 under a maximum vane-rotor phase-advance state, whereas

DESCRIPTION OF THE PREFERRED EMBODIMENTS

Details of the internal combustion engine VTC apparatus of each of the embodiments according to the invention are hereinafter described in reference to the drawings. By the way, in the shown embodiments, the VTC apparatus is applied to a valve actuating device of the intake-valve side of an internal combustion engine.

[First embodiment]

Figure 1:
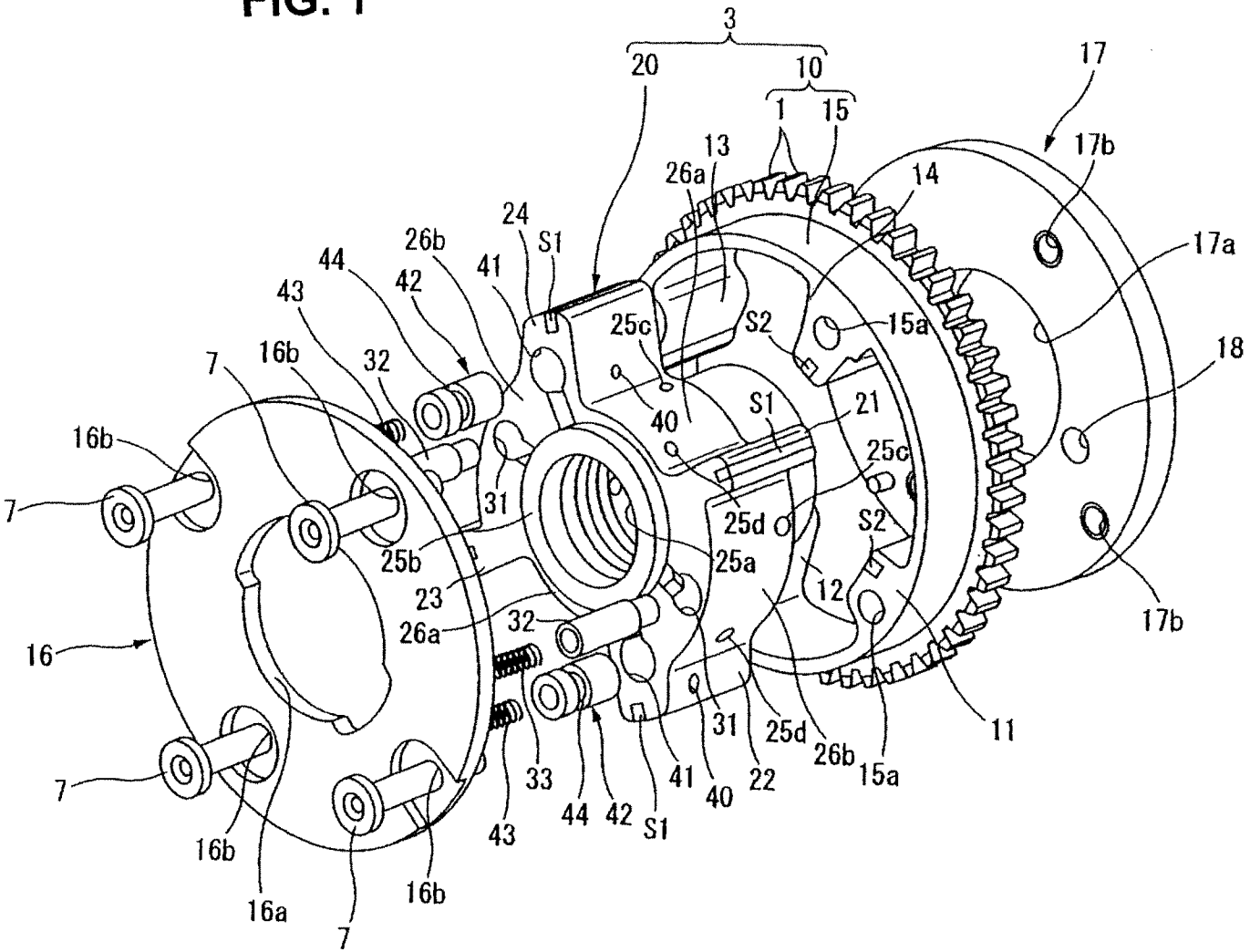
FIG. 1 is a perspective disassembled view illustrating major component parts of a hydraulically-operated four-vane equipped internal combustion engine valve timing control (VTC) apparatus of the first embodiment according to the invention.
Figure 2:
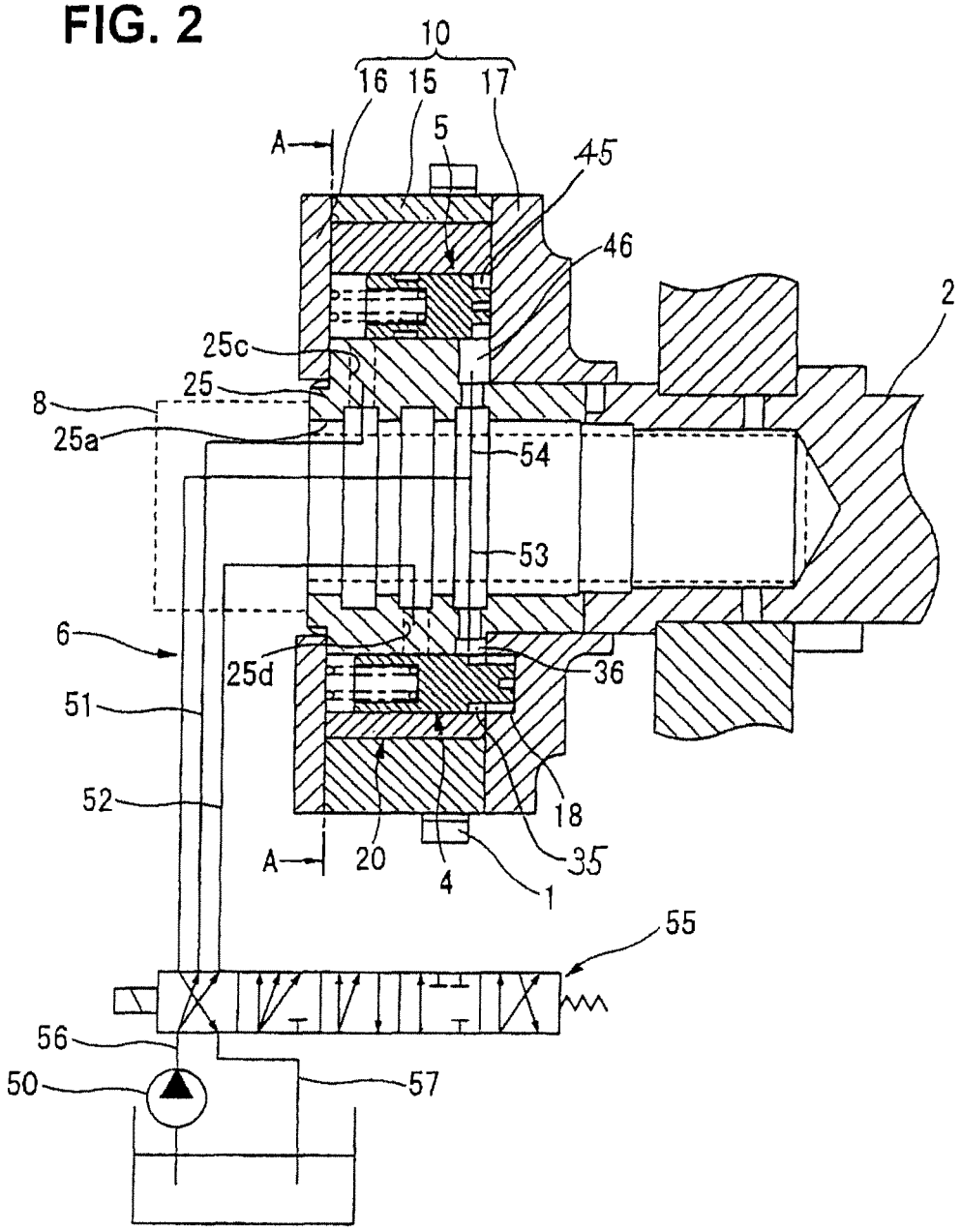
FIG. 2 is a longitudinal cross-sectional view illustrating the internal combustion engine VTC apparatus shown in FIG. 1.
Figure 3:
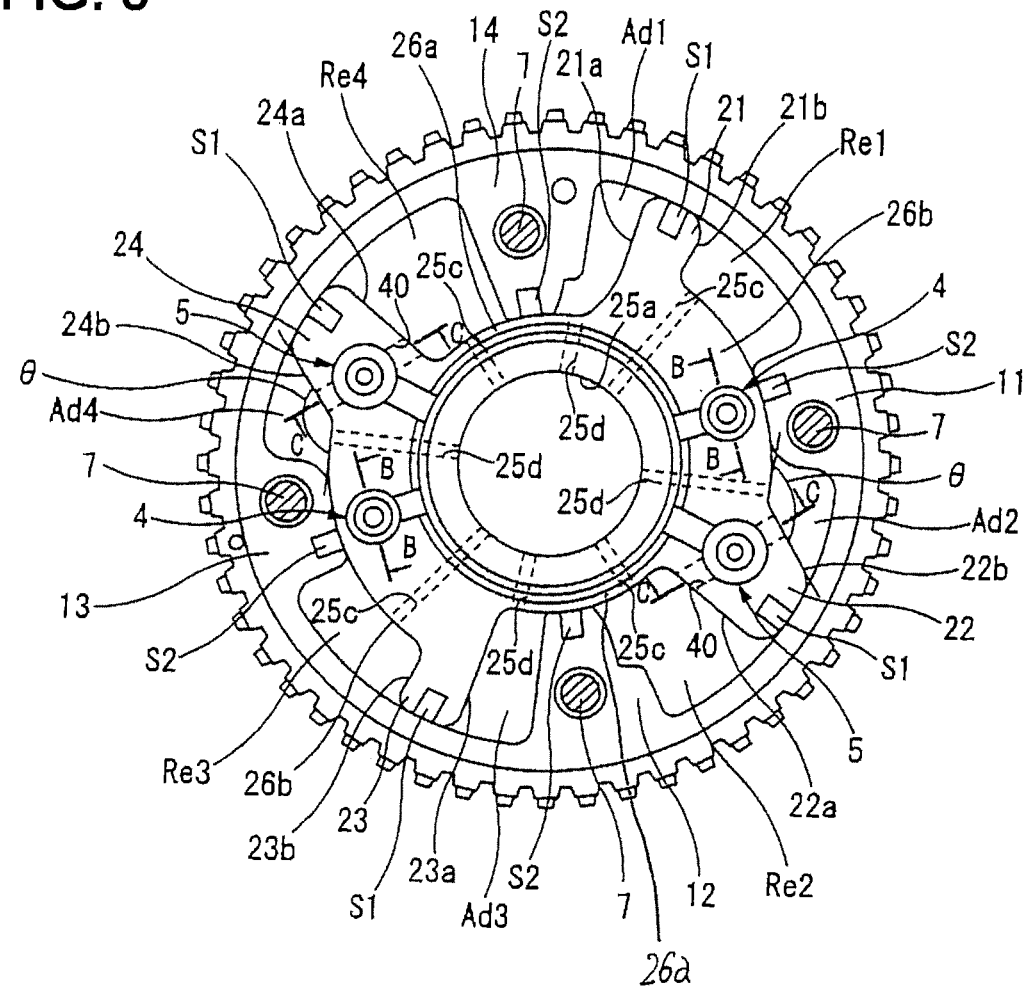
FIG. 3 is a lateral cross-sectional view taken along the line A-A of FIG. 2.

Referring now to the drawings, particularly to FIGS. 1-8B, there is shown the internal combustion engine VTC apparatus of the first embodiment. As shown in FIGS. 1-3, the valve timing control (VTC) apparatus of the first embodiment includes a sprocket 1, a camshaft 2, a phase-change mechanism 3, a pair of lock mechanisms 4, 4, a pair of fluid-communication control mechanisms 5, 5, and a hydraulic-pressure supply-discharge mechanism 6. Sprocket 1 is rotated and driven by torque transmitted from a crankshaft (not shown). Camshaft 2 is configured to be rotated relatively to the sprocket 1. Phase-change mechanism 3 is interposed between the sprocket 1 and the camshaft 2 for converting a relative angular phase between the sprocket 1 and the camshaft 2. Lock mechanisms 4, 4 are configured to restrict relative rotation between the sprocket 1 and the camshaft 2 by locking the phase-change mechanism 3 at a predetermined intermediate angular position. Fluid-communication control mechanisms 5, 5 are configured to establish or block (i) fluid-communication of a first prescribed adjacent pair (Re2, Ad2) of phase-retard chambers Re1-Re4 (described later) and phase-advance chambers Ad1-Ad4 (described later) and (ii) fluid-communication of a second prescribed adjacent pair (Re4, Ad4) of phase-retard chambers Re1-Re4 and phase-advance chambers Ad1-Ad4. Hydraulic-pressure supply-discharge mechanism 6 is configured to selectively operate the phase-change mechanism 3, the lock mechanisms 4, 4, and the fluid-communication control mechanism 5, 5 by switching between pressure-supply and pressure-discharge to and from each of the phase-change mechanism 3, the lock mechanisms 4, 4, and the fluid-communication control mechanism 5, 5. As described later, the previously-discussed fluid-communication control mechanisms 5, 5 are provided to control switching between a fluid-communication established state (simply, a communication state) and a fluid-communication blocked state (a non-communication state) of each of the first prescribed adjacent chamber pair (Re2, Ad2) and the second prescribed adjacent chamber pair (Re4, Ad4).

As shown in FIGS. 1-3, phase-change mechanism 3 is comprised of a housing 10, a vane rotor 20, and phase-retard working chambers (that is, a first phase-retard chamber Re1, a second phase-retard chamber Re2, a third phase-retard chamber Re3, and a fourth phase-retard chamber Re4) and phase-advance working chambers (that is, a first phase-advance chamber Ad1, a second phase-advance chamber Ad2, a third phase-advance chamber Ad3, and a fourth phase-advance chamber Ad4). As best seen in FIG. 3, in the first embodiment, housing 10 has four shoes (that is, a first shoe 11, a second shoe 12, a third shoe 13, and a fourth shoe 14) formed integral with the sprocket 1 and configured to protrude radially inward from the inner periphery of sprocket 1. Vane rotor 20 is rotatably housed in the inner periphery of housing 10 such that relative rotation of vane rotor 20 to housing 10 is permitted. Also, vane rotor 20 is fixedly connected to one axial end (the front end) of camshaft 2 such that vane rotor 20 can be rotated integrally with the camshaft 2. In the first embodiment, as seen from the lateral cross section of FIG. 3, the internal space, defined between the shoes 11-14 of housing 10 and four vanes (described later) of vane rotor 20, are partitioned into four phase-retard chambers Re1-Re4 and four phase-advance chambers Ad1-Ad4. The angular phase of vane rotor 20 (camshaft 2) relative to housing 10 (sprocket 1 or the crankshaft) is variably controlled by selectively switching between hydraulic-pressure supply to the phase-retard chambers Re1-Re4 and hydraulic-pressure supply (working-fluid supply) to the phase-retard chambers Re1-Re4 by way of the hydraulic-pressure supply-discharge mechanism 6.

Housing 10 is constructed by a substantially cylindrical housing main body 15, a front plate 16 configured to hermetically close the front opening end of housing main body 15, and a rear plate 17 configured to hermetically close the rear opening end of housing main body 15. Front plate 16, housing main body 15, and rear plate 17 are axially fastened together with a plurality of bolts 7 and integrally connected to each other by screwing these bolts 7 into the rear plate 17.

Housing main body 15 is formed of a sintered metal material and formed into a substantially cylindrical shape. As previously discussed, the inner periphery of housing main body 15 is formed integral with radially-inward protruding shoes 11-14, whereas the outer periphery of housing main body 15 is formed integral with the sprocket 1. As clearly shown in FIG. 1, each of shoes 11-14 has a bolt-insertion hole (a through hole) 15*a* through which bolt 7 is screwed into the rear plate 17.

Front plate 16 is formed of a metal material and formed into a comparatively thin-wall disk shape. The center of front plate 16 is formed as a substantially circular cam-bolt receiving bore 16*a* in which the head of a cam bolt 8 is received. Also, front plate 16 has four bolt insertion holes 16*b* formed around the cam-bolt receiving bore 16*a* and circumferentially spaced from each other. When installing the front plate 16 and the housing main body 15 on the rear plate 17, four bolts 7 are inserted into respective bolt insertion holes 16*b*.

Rear plate 17 is formed of a metal material and formed into a substantially disk shape. The center of rear plate 17 is formed as a substantially circular camshaft-end insertion bore 17*a* into which the front end of camshaft 2 is inserted. Also, rear plate 17 has four female screw-threaded holes 17*b* formed around the camshaft-end insertion bore 17*a* and circumferentially spaced from each other. When assembling the three component parts 16, 15, and 17, four bolts 7 are screwed into respective female screw-threaded holes 17*b* of rear plate 17.

Vane rotor 20 is comprised of a rotor main body 15 and a plurality of vanes (four vanes 21-24 in the first embodiment). Rotor main body 15 and vanes 21-24 are formed of a metal material. Rotor main body 25 is integrally connected to the axial end of camshaft 2 by means of the cam bolt 8. Rotor main body 25 is formed integral with four vanes (that is, a first vane 21, a second vane 22, a third vane 23, and a fourth vane 24) configured to protrude radially outward from the outer periphery of rotor main body 25 and almost equidistantly-spaced from each other at approximately equal intervals, such as 90 degrees, in the circumferential direction. The first vane 21 is configured to be substantially conformable to the internal space defined between the fourth shoe 14 and the first shoe 11. The second vane 22 is configured to be substantially conformable to the internal space defined between the first shoe 11 and the second shoe 12. The third vane 23 is configured to be substantially conformable to the internal space defined between the second shoe 12 and the third shoe 13. The fourth vane 24 is configured to be substantially conformable to the internal space defined between the third shoe 13 and the fourth shoe 14.

By the way, four shoes 11-14 have respective axially-elongated seal retaining grooves, formed in their innermost ends (apexes) and extending in the axial direction. Each of the four seal retaining grooves of shoes 11-14 is substantially formed into a rectangle. Four oil seal members (four apex seals) S2, S2, S2, S2, each having a substantially square lateral cross section, are fitted into the respective seal retaining grooves of four shoes 11-14 so as to bring the four apex seals S2 into sliding-contact with the outer peripheral surface of rotor main body 25 of vane rotor 20. More concretely, the seal member S2 of the fourth shoe 14 is brought into sliding-contact with the outer peripheral surface of a small-diameter portion 26*a* of rotor main body 25 configured to circumferentially extend between the fourth vane 24 and the first vane 21. The seal member S2 of the first shoe 11 is brought into sliding-contact with the outer peripheral surface of a large-diameter portion 26*b* of rotor main body 25 configured to circumferentially extend between the first vane 21 and the second vane 22. The seal member S2 of the second shoe 12 is brought into sliding-contact with the outer peripheral surface of a small-diameter portion 26*a* of rotor main body 25 configured to circumferentially extend between the second vane 22 and the third vane 23. The seal member S2 of the third shoe 13 is brought into sliding-contact with the outer peripheral surface of a large-diameter portion 26*b* of rotor main body 25 configured to circumferentially extend between the third vane 23 and the fourth vane 24. In a similar manner to the shoes 11-14, four vanes 21-24 have respective axially-elongated seal retaining grooves, formed in their outermost ends (apexes) and extending in the axial direction. Each of the four seal retaining grooves of vanes 21-24 is substantially formed into a rectangle. Four oil seal members (four apex seals) S1, S1, S1, S1, each having a substantially square lateral cross section, are fitted into the respective seal retaining grooves of four vanes 21-24 so as to bring the four apex seals S1 into sliding-contact with the inner peripheral surface of housing main body 15 of housing 10. More concretely, the seal member S1 of the first vane 21 is brought into sliding-contact with the inner peripheral surface of housing main body 15 configured to circumferentially extend between the fourth shoe 14 and the first shoe 11. The seal member S1 of the second vane 22 is brought into sliding-contact with the inner peripheral surface of housing main body 15 configured to circumferentially extend between the first shoe 11 and the second shoe 12. The seal member S1 of the third vane 23 is brought into sliding-contact with the inner peripheral surface of housing main body 15 configured to circumferentially extend between the second shoe 12 and the third shoe 13. The seal member S1 of the fourth vane 24 is brought into sliding-contact with the inner peripheral surface of housing main body 15 configured to circumferentially extend between the third shoe 13 and the fourth shoe 14. Accordingly, the internal space defined between the fourth shoe 14 and the first shoe 11 is partitioned into the first phase-advance chamber Ad1 and the first phase-retard chamber Re1 by the first vane 21. The internal space defined between the first shoe 11 and the second shoe 12 is partitioned into the second phase-advance chamber Ad2 and the second phase-retard chamber Re2 by the second vane 22. The internal space defined between the second shoe 12 and the third shoe 13 is partitioned into the third phase-advance chamber Ad3 and the third phase-retard chamber Re3 by the third vane 23. The internal space defined between the third shoe 13 and the fourth shoe 14 is partitioned into the fourth phase-advance chamber Ad4 and the fourth phase-retard chamber Re4 by the fourth vane 24.

Rotor main body 25 is formed into a deformed cylindrical shape. The center of rotor main body 25 is formed as a cam-bolt insertion hole (an axial through hole) 25*a* into which the shank of cam bolt 8 is inserted. The front end of cam-bolt insertion hole 25*a* of rotor main body 25 is formed as a slightly axially-protruding annular cam-bolt seat section 25*b* on which the head of cam bolt 8 is seated (see FIG. 1).

Regarding the deformed rotor main body 25, the second vane 22 and the fourth vane 24, each of which is equipped with the fluid-communication control mechanism 5, are arranged to be diametrically opposed with respect to the rotation center of vane rotor 20. Also, the first vane 21 and the third vane 23, each of which is not equipped with the fluid-communication control mechanism 5, are arranged to be diametrically opposed with respect to the rotation center of vane rotor 20. The circumference of rotor main body 25 defined between the fourth vane 24 and the first vane 21 and the circumference of rotor main body 25 defined between the second vane 22 and the third vane 23 are formed as the diametrically-opposed, comparatively thin-walled small-diameter portions 26*a*, 26*a*. In contrast, the circumference of rotor main body 25 defined between the first vane 21 and the second vane 22 and the circumference of rotor main body 25 defined between the third vane 23 and the fourth vane 24 are formed as the diametrically-opposed, comparatively thick-walled large-diameter portions 26*b*, 26*b*.

With the previously-discussed deformed configuration of rotor main body 25, the pressure-receiving surface area of each of the side face 24*a* of the fourth vane 24 and the side face 21*a* of the first vane 21, both facing the small-diameter portion 26*a* defined between the fourth vane 24 and the first vane 21, and the pressure-receiving surface area of each of the side face 22*a* of the second vane 22 and the side face 23*a* of the third vane 23, both facing the small-diameter portion 26*a* defined between the second vane 22 and the third vane 23, are dimensioned to be greater than the pressure-receiving surface area of each of the side face 21*b* of the first vane 21 and the side face 22*b* of the second vane 22, both facing the large-diameter portion 26*b* defined between the first vane 21 and the second vane 22, and the pressure-receiving surface area of each of the side face 23*b* of the third vane 23 and the side face 24*b* of the fourth vane 24, both facing the large-diameter portion 26*b* defined between the third vane 23 and the fourth vane 24. In other words, the first vane 21 (not equipped with the fluid-communication control mechanism 5) and the third vane 23 (not equipped with the fluid-communication control mechanism 5) are configured such that the summed value of the pressure-receiving surface area of the side face 21*a* of the first vane 21, facing the first phase-advance chamber Ad1, and the pressure-receiving surface area of the side face 23*a* of the third vane 23, facing the third phase-advance chamber Ad3, is set greater than the summed value of the pressure-receiving surface area of the side face 21*b* of the first vane 21, facing the first phase-retard chamber Re1, and the pressure-receiving surface area of the side face 23*b* of the third vane 23, facing the third phase-retard chamber Re3. In contrast, the second vane 22 (equipped with the fluid-communication control mechanism 5) and the fourth vane 24 (equipped with the fluid-communication control mechanism 5) are configured such that the summed value of the pressure-receiving surface area of the side face 22*b* of the second vane 22, facing the second phase-advance chamber Ad2, and the pressure-receiving surface area of the side face 24*b* of the fourth vane 24, facing the fourth phase-advance chamber Ad4, is set less than the summed value of the pressure-receiving surface area of the side face 22*a* of the second vane 22, facing the second phase-retard chamber Re2, and the pressure-receiving surface area of the side face 24*a* of the fourth vane 24, facing the fourth phase-retard chamber Re4.

Also, regarding the deformed configuration of rotor main body 25, the side face 24*a* of the fourth vane 24 and the side face 21*a* of the first vane 21, both facing the small-diameter portion 26*a* defined between the fourth vane 24 and the first vane 21, are arranged to be circumferentially opposed to each other. The side face 22*a* of the second vane 22 and the side face 23*a* of the third vane 23, both facing the small-diameter portion 26*a* defined between the second vane 22 and the third vane 23, are arranged to be circumferentially opposed to each other. Additionally, the side face 21*b* of the first vane 21 and the side face 22*b* of the second vane 22, both facing the large-diameter portion 26*b* defined between the first vane 21 and the second vane 22, are arranged to be circumferentially opposed to each other. The side face 23*b* of the third vane 23 and the side face 24*b* of the fourth vane 24, both facing the large-diameter portion 26*b* defined between the third vane 23 and the fourth vane 24, are arranged to be circumferentially opposed to each other. Hence, the previously-discussed pressure-receiving surface area differences are canceled. That is, hydraulic pressures (working fluid pressures) acting on the vane rotor 20 are totally balanced to each other without undesirably biased hydraulic pressure force. This ensures or permits smooth relative rotation of vane rotor 20 to housing 10.

Additionally, the deformed rotor main body 25 is configured, such that an angle θ between the side face 22*b* of the second vane 22, facing the large-diameter portion 26*b*, and a tangential line of the side face 22*b* tangent to the outer peripheral surface of the large-diameter portion 26*b* defined between the two adjacent vanes 21-22 is an obtuse angle, and that an angle θ between the side face 24*b* of the fourth vane 24, facing the large-diameter portion 26*b*, and a tangential line of the side face 24*b* tangent to the outer peripheral surface of the large-diameter portion 26*b* defined between the two adjacent vanes 23-24 is an obtuse angle. This ensures a good workability of vane rotor 20.

As seen from the lateral cross section of FIG. 3, four phase-retard side communication holes (radial through holes) 25*c* are formed in the rotor main body 25. A phase-retard side oil passage 51 (described later), which is formed in the camshaft 2, is communicated with phase-retard chambers Re1-Re4 through respective phase-retard side communication holes 25*c*. Thus, working fluid (working oil) is introduced from the hydraulic-pressure supply-discharge mechanism 6 through the phase-retard side oil passage 51 of camshaft 2 by way of respective phase-retard side communication holes 25*c*.

In addition to the above, four phase-advance side communication holes (radial through holes) 25*d* are formed in the rotor main body 25. A phase-advance side oil passage 52 (described later), which is formed in the camshaft 2, is communicated with phase-advance chambers Ad1-Ad4 through respective phase-advance side communication holes 25*d*. Thus, working fluid (working oil) is introduced from the hydraulic-pressure supply-discharge mechanism 6 through the phase-advance side oil passage 52 of camshaft 2 by way of respective phase-advance side communication holes 25*d*.

As shown in FIGS. 1-4, each of lock mechanisms 4, 4 is arranged or installed substantially in a middle of the associated large-diameter portion 26*b* and provided to hold a relative angular phase of vane rotor 20 to housing 10 at a predetermined intermediate angular phase between a maximum phase-retard position and a maximum phase-advance position. That is, each of lock mechanisms 4, 4 is mainly constructed by a pin housing hole (simply, a housing hole) 31, a lock pin 32 serving as a substantially cylindrical lock member, and a coil spring 33. Pin housing hole 31 is formed in the large-diameter portion 26*b* as an axial through hole. Lock pin 32 is slidably accommodated in the pin housing hole 31 for restricting rotary motion of vane rotor 20 relative to housing 10 by engagement with an engagement hole 18 (i.e., a lock recessed groove) recessed or bored in the rear plate 17. Coil spring 33 is interposed between the lock pin 32 and the front plate 16 for permanently biasing the lock pin 32 toward the rear plate 17.

Figure 4:
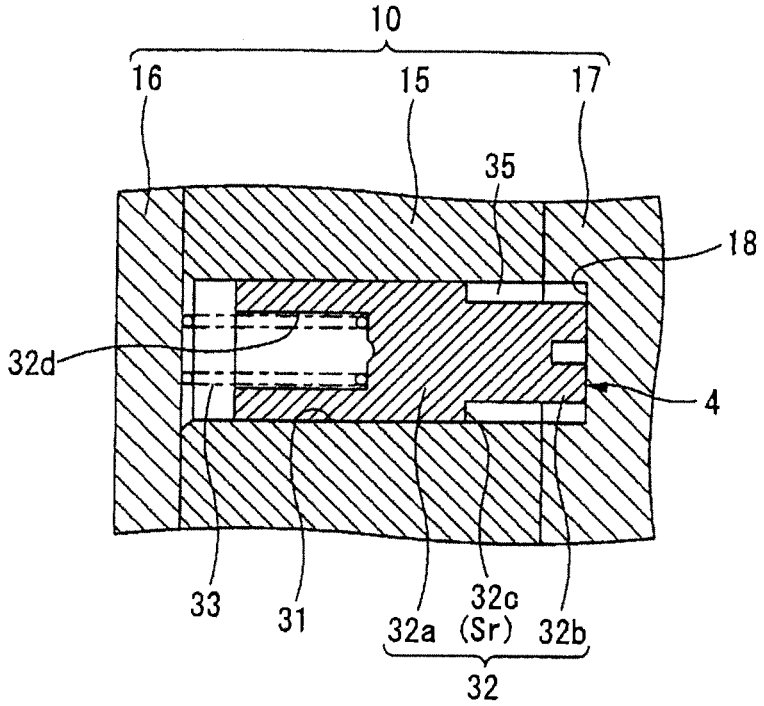
FIG. 4 is a cross-sectional view taken along the line B-B of FIG. 3.

As seen from the cross section of FIG. 4, lock pin 32 is formed as a stepped cylindrical shape whose diameter increases toward its front end and which is constructed by a large-diameter portion 32*a*, a small-diameter portion 32*b*, and a stepped or shouldered portion 32*c* between the large-diameter portion 32*a* and the small-diameter portion 32*b*. Under preload, coil spring 33 is elastically installed in a cylindrical-hollow spring housing portion 32*d*, bored in the front end of large-diameter portion 32*a*. By virtue of the stepped portion 32*c* of lock pin 32, a pressure-receiving chamber 35 is defined between the outer peripheral surface of small-diameter portion 32*b* and the inner peripheral surface of pin housing hole 31. The aforementioned pressure-receiving chambers 35, 35, defined around small-diameter portions 32*b*, 32*b* of two lock pins 32, 32, are configured to be communicated with a lock mechanism passage 53 through respective communication grooves 36, 36 (see FIG. 2) cut in the rear end faces of large-diameter portions 26*b*, 26*b* of the deformed rotor main body 25, facing the rear plate 17. Each of lock mechanisms 4, 4 is configured such that lock pin 32 retreats and moves out of engagement with the engagement hole 18 against the spring force of coil spring 33 by applying hydraulic pressure (serving as an unlock pressure (exactly, lock-to-unlock switching pressure) introduced from the lock mechanism passage 53) to the stepped portion 32*c*.

As shown in FIGS. 1-3 and 5, fluid-communication control mechanisms 5, 5 are provided at the second vane 22 and the fourth vane 24, respectively. In the VTC apparatus of the first embodiment, the first fluid-communication control mechanism 5, provided at the second vane 22, is mainly constructed by a communication hole 40 which is formed in the second vane 22 such that the two adjacent chambers Re2 and Ad2 are communicated with each other through the communication hole 40, a pin housing hole 41, a communication pin 42, and a coil spring 43. Pin housing hole 41 is formed in the second vane 22 as an axial through hole substantially penetrating a midpoint of communication hole 40. Communication pin 42 serves as a valve element slidably accommodated in the pin housing hole 41 of the second vane 22. Coil spring 43 (i.e., a biasing member) is interposed between the communication pin 42 of the second vane 22 and the front plate 16 for permanently biasing the communication pin 42 toward the rear plate 17. In a similar manner, the second fluid-communication control mechanism 5, provided at the fourth vane 24, is mainly constructed by a communication hole 40 which is formed in the fourth vane 24 such that the two adjacent chambers Re4 and Ad4 are communicated with each other through the communication hole 40, a pin housing hole 41, a communication pin 42, and a coil spring 43. Pin housing hole 41 is formed in the fourth vane 24 as an axial through hole substantially penetrating a midpoint of communication hole 40. Communication pin 42 serves as a valve element slidably accommodated in the pin housing hole 41 of the fourth vane 24. Coil spring 43 is interposed between the communication pin 42 of the fourth vane 24 and the front plate 16 for permanently biasing the communication pin 42 toward the rear plate 17.

As seen from the lateral cross section of FIG. 3, the communication hole 40 of the second vane 22 is configured such that the side face 22*a* of the root of the second vane 22, facing the small-diameter portion 26*a*, and the side face 22*b* of the root of the second vane 22, facing the large-diameter portion 26*b*, are communicated with each other through the communication hole 40. In a similar manner, the communication hole 40 of the fourth vane 24 is configured such that the side face 24*a* of the root of the fourth vane 24, facing the small-diameter portion 26*a*, and the side face 24*b* of the root of the fourth vane 24, facing the large-diameter portion 26*b*, are communicated with each other through the communication hole 40. That is, communication hole 40 is configured to be inclined with respect to the width direction (the circumferential direction) of each of the second vane 22 and the fourth vane 24. Hence, as compared to one opening end of communication hole 40, facing the large-diameter portion 26*b*, the other opening end of communication hole 40, facing the small-diameter portion 26*a*, is formed radially inward.

Figure 5:
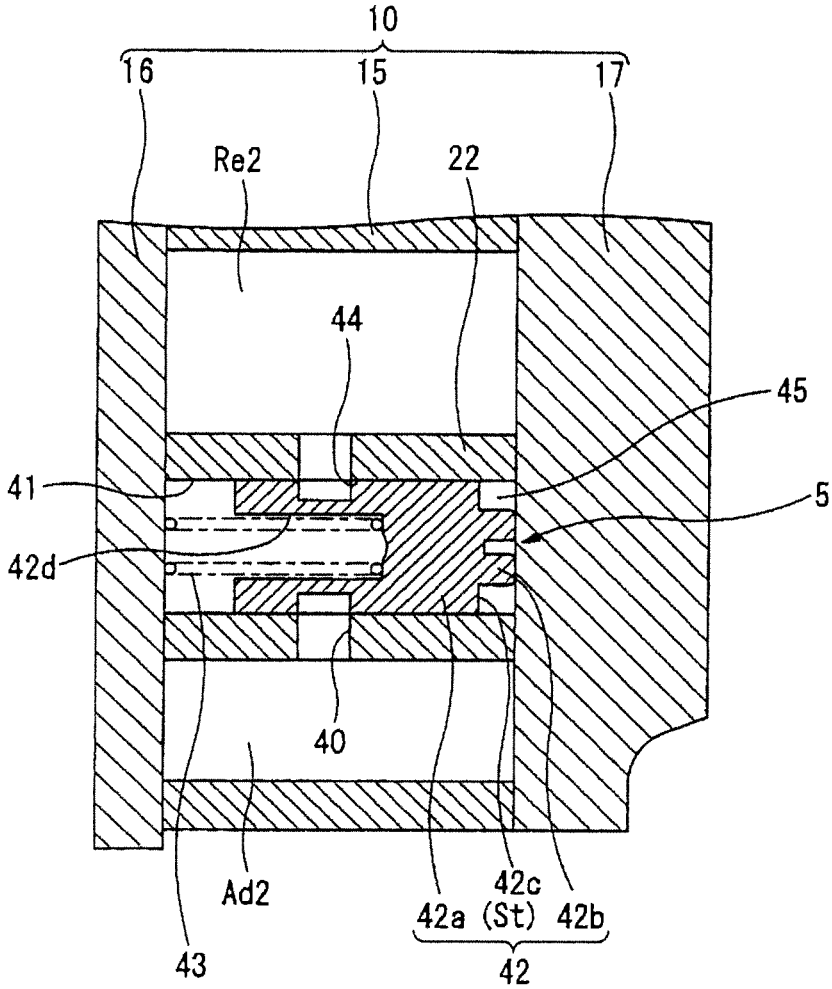
FIG. 5 is a cross-sectional view taken along the line C-C of FIG. 3.

As seen from the cross section of FIG. 5, communication pin 42 is formed as a stepped cylindrical shape whose diameter increases toward its front end and which is constructed by a large-diameter portion 42*a*, a small-diameter portion 42*b*, and a stepped or shouldered portion 42*c* between the large-diameter portion 42*a* and the small-diameter portion 42*b*. Under preload, coil spring 43 is elastically installed in a cylindrical-hollow spring housing portion 42*d*, bored in the front end of large-diameter portion 42*a*. An annular groove 44 is formed or cut around the entire circumference of an axial intermediate section of large-diameter portion 42*a*. The groove width of annular groove 44 is dimensioned to be identical to the inside diameter of communication hole 40. Under a specific condition in which communication pin 42 has moved to its maximum advanced axial position, the annular groove 44 is brought into proper alignment with the communication groove 40 (see FIGS. 6B and 7B). In concert with an increase in retreating-movement of communication pin 42 retreated from the maximum advanced axial position, the opening area of the annular groove 44 opened into the communication hole 40, in other words, the flow-path cross-sectional area of the communication hole 40 tends to narrow or reduce. Immediately when communication pin 42 has retreated to an axial position greater than a given position, fluid-communication between the communication hole 40 and the annular groove 44 is blocked by the outer periphery of large-diameter portion 42*a* of communication pin 42 (see FIG. 8B). As set out above, depending on the flow-path cross-sectional area of communication hole 40, determined depending on the axial position of annular groove 44, (i) switching between a communication state and a non-communication state of the second phase-retard chamber Re2 and the second phase-advance chamber Ad2 and (ii) switching between a communication state and a non-communication state of the fourth phase-retard chamber Re4 and the fourth phase-advance chamber Ad4 can be controlled concurrently. In other words, switching between a communication state of each communication hole 40 and a non-communication state of each communication hole 40 can be controlled concurrently.

By virtue of the stepped portion 42*c* of communication pin 42, a pressure-receiving chamber 45 is defined between the outer peripheral surface of small-diameter portion 42*b* and the inner peripheral surface of pin housing hole 41. The aforementioned pressure-receiving chambers 45, 45, defined around small-diameter portions 42*b*, 42*b* of two communication pins 42, 42, are configured to be communicated with a fluid-communication control mechanism passage 54 through respective communication grooves 46, 46 (see FIG. 2) cut in the rear end faces of large-diameter portions 26*b*, 26*b* of the deformed rotor main body 25, facing the rear plate 17. Each of fluid-communication control mechanisms 5, 5 is configured such that communication pin 42 retreats against the spring force of coil spring 43 by applying hydraulic pressure (serving as a switching pressure (exactly, communication-to-non-communication switching pressure) introduced from the fluid-communication control mechanism passage 54) to the stepped portion 42*c*.

By the way, in the first embodiment, application of hydraulic pressure (lock-to-unlock switching pressure) from lock mechanism passage 53 to the stepped portion 32*c* of lock pin 32 is substantially concurrent with application of hydraulic pressure (communication-to-non-communication switching pressure) from fluid-communication control mechanism passage 54 to the stepped portion 42*c* of communication pin 42, but the timing of retreating-movement of communication pin 42 is earlier than the timing of retreating-movement of lock pin 32, for the reasons discussed below. This is because, in the VTC apparatus of the first embodiment, the pressure-receiving surface area "St" (see FIG. 5) of the stepped portion 42*c* of communication pin 42 is set or dimensioned to be greater than the pressure-receiving surface area "Sr" (see FIG. 4) of the stepped portion 32*c* of lock pin 32. Instead of the previously-noted setting of the two different pressure-receiving surface areas "St" and "Sr", the spring constant (spring stiffness) of coil spring 43 of fluid-communication control mechanism 5 may be set less than the spring constant (spring stiffness) of coil spring 33 of lock mechanism 4 so as to permit or realize the timing of retreating-movement of communication pin 42 relatively earlier than the timing of retreating-movement of lock pin 32. In lieu thereof, the set spring load (concretely, a depth of spring housing portion 42*d*) of coil spring 43 of fluid-communication control mechanism 5 may be set less than the set spring load (concretely, a depth of spring housing portion 32*d*) of coil spring 33 of lock mechanism 4 so as to permit or realize the timing of retreating-movement of communication pin 42 relatively earlier than the timing of retreating-movement of lock pin 32.

Returning to FIG. 2, hydraulic-pressure supply-discharge mechanism 6 is mainly constructed by an oil pump 50, the phase-retard side oil passage 51, the phase-advance side oil passage 52, the lock mechanism passage 53, the fluid-communication control mechanism passage 54, a supply passage 56, and a drain passage 57. Phase-retard side oil passage 51 is provided for pressure-supply and pressure-discharge to and from phase-retard chambers Re1-Re4 through respective phase-retard side communication holes 25*c*. Phase-advance side oil passage 52 is provided for pressure-supply and pressure-discharge to and from phase-advance chambers Ad1-Ad4 through respective phase-advance side communication holes 25*d*. Lock mechanism passage 53 is provided for pressure-supply and pressure-discharge to and from pin housing holes 31 through respective communication grooves 36. Fluid-communication control mechanism passage 54 is provided for pressure-supply and pressure-discharge to and from pin housing holes 41 through respective communication grooves 46. Supply passage 56 is provided for selectively supplying hydraulic pressure from oil pump 50 to each of oil passages 51-52 and mechanism passages 53-54 via a generally-known electromagnetic directional control valve 55, such as an electromagnetic-solenoid operated, six-way, five-position, spring-offset, proportional control valve. Drain passage 57 is provided for draining working fluid (hydraulic pressure) from any one of the phase-retard side oil passage 51, the phase-advance side oil passage 52, and the lock mechanism passage 53 (in other words, the fluid-communication control mechanism passage 54 branched from the lock mechanism passage 53) not connected to oil pump 50 via the electromagnetic directional control valve 55. By the way, the previously-discussed electromagnetic directional control valve 55 is configured to control switching between fluid-communication between oil pump 50 (supply passage 56) and each of oil passages 51-52 and mechanism passages 53-54 and fluid-communication between drain passage 57 and each of oil passages 51-52 and mechanism passages 53-54, responsively to a control current from an electronic control unit (ECU) (not shown).

Figure 6A:
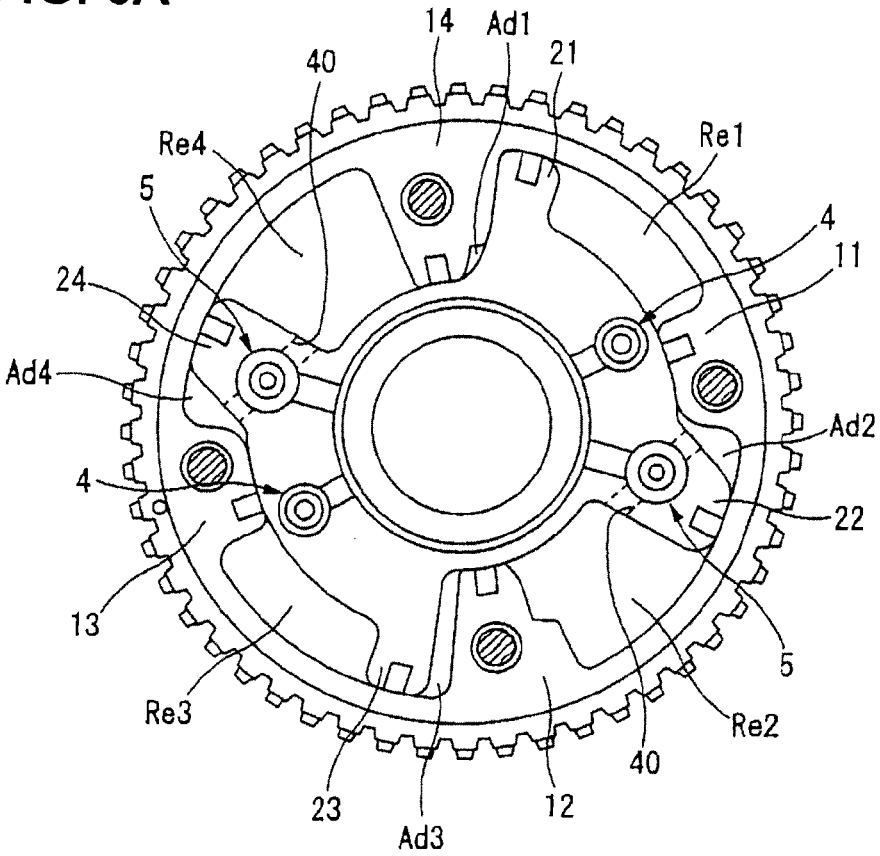
Figure 6B:
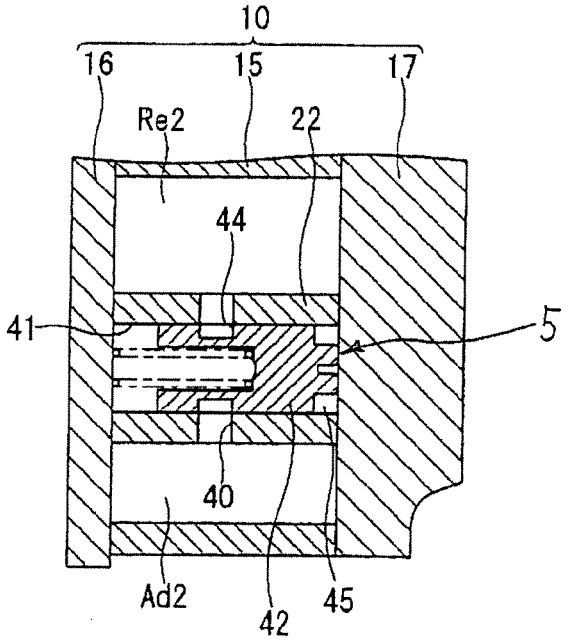
FIG. 6B is a cross-sectional view taken along the line C-C of FIG. 3 under the maximum vane-rotor phase-retard state.
Figure 7A:
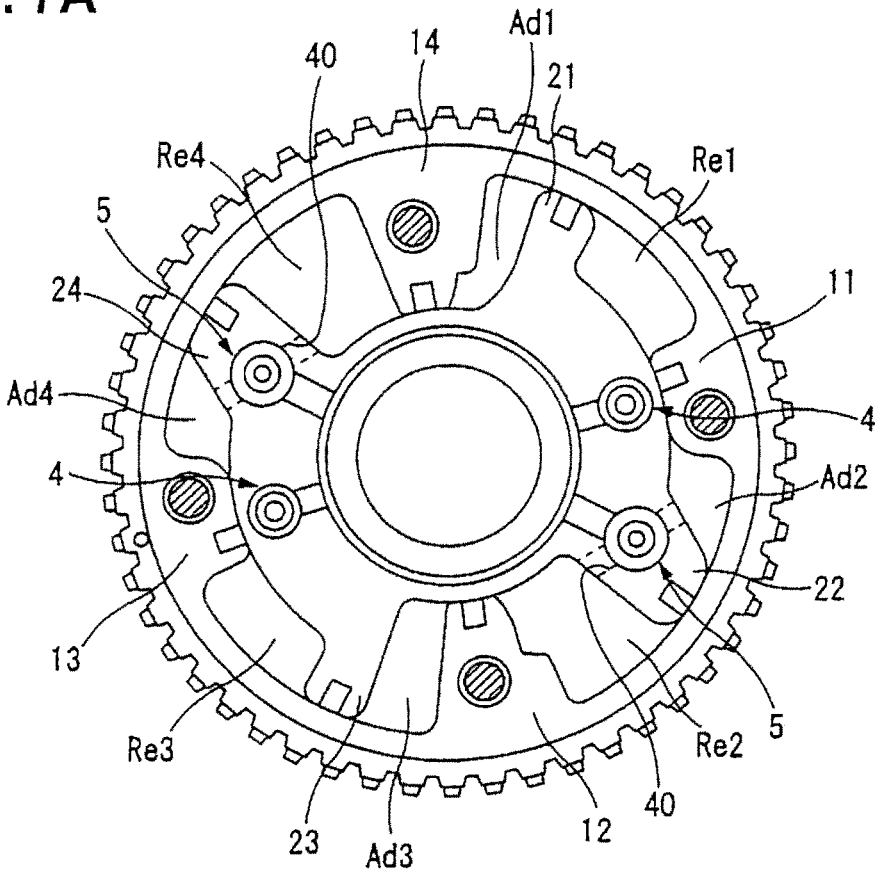
Figure 7B:
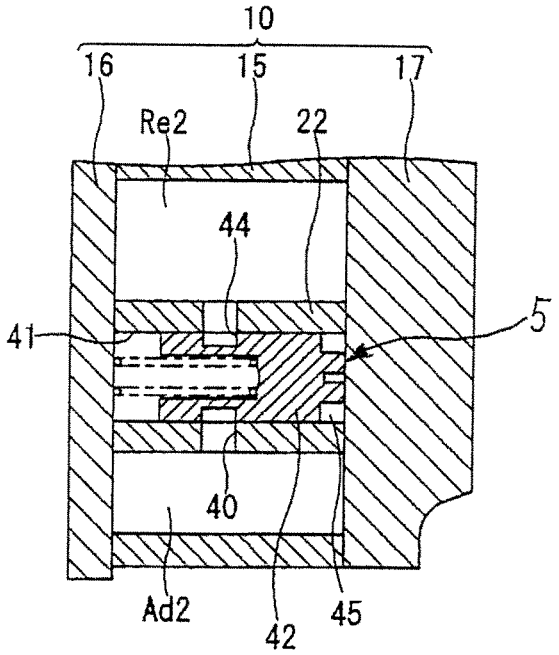
FIG. 7B is a cross-sectional view taken along the line C-C of FIG. 3 under the vane-rotor lock state.
Figure 8A:
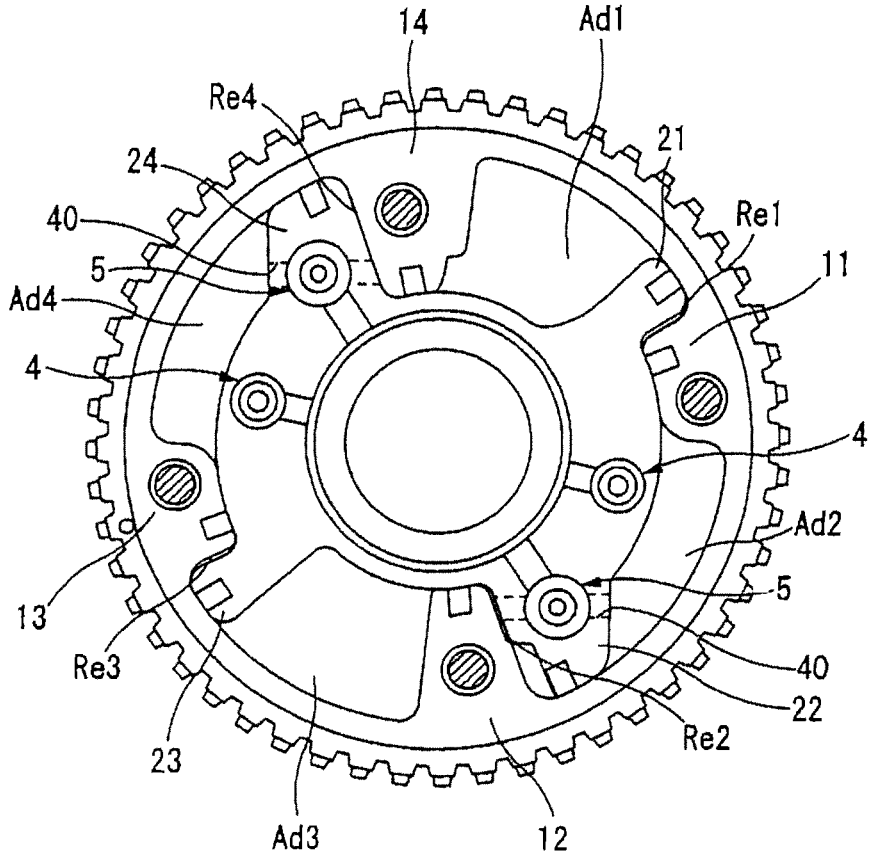
Figure 8B:
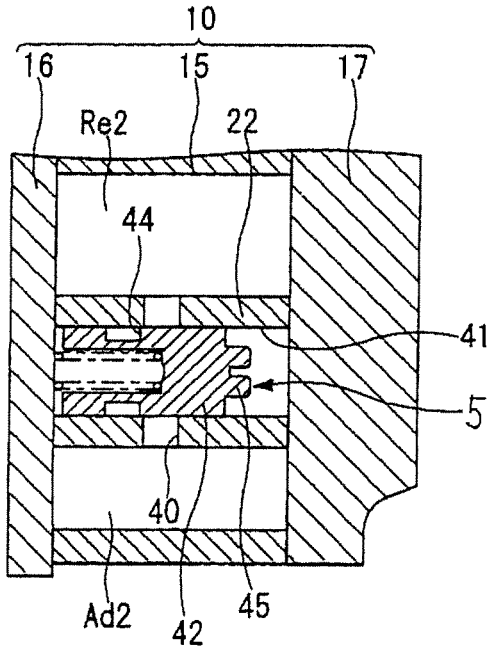
FIG. 8B is a cross-sectional view taken along the line C-C of FIG. 3 under the maximum vane-rotor phase-advance state.

The operation and effects of the VTC apparatus of the first embodiment are hereunder described in detail in reference to FIGS. 6A-6B, 7A-7B, and 8A-8B. FIGS. 6A-6B explain a communication state of each of fluid-communication control mechanisms 5, 5 employed in the second vane 22 and the fourth vane 24 under the maximum phase-retard state of vane rotor 20. FIGS. 7A-7B explain a communication state of each of fluid-communication control mechanisms 5, 5 employed in the second vane 22 and the fourth vane 24 under the lock state of vane rotor 20 locked at the predetermined intermediate angular position. FIGS. 8A-8B explain a non-communication state of each of fluid-communication control mechanisms 5, 5 employed in the second vane 22 and the fourth vane 24 under the maximum phase-advance state of vane rotor 20.

Suppose that, during engine running, the engine has stalled unintendedly and thus the engine has stopped running without turning the ignition switch OFF. At this time, there is an increased tendency for the relative angular phase of vane rotor 20 to housing 10 to be stopped or retained undesirably at a phase angle deviated from the predetermined intermediate angular position, corresponding to the lock position of vane rotor 20. In such a situation, assume that the viscous resistance of working fluid is high owing to a cold engine. Owing to a high viscous resistance of working fluid, hitherto, it was difficult to ensure a rapid rotary motion of the vane rotor 20 toward the predetermined intermediate angular position by positive and negative alternating torque acting on the camshaft 2 due to spring forces of valve springs, even after establishment of fluid-communication between the previously-discussed two adjacent hydraulic chambers (i.e., the phase-retard hydraulic chamber and the phase-advance hydraulic chamber), arranged circumferentially adjacent to each other.

In contrast, in the VTC apparatus of the first embodiment, when the engine has stopped running, oil pump 50 has also stopped operating. Therefore, there is a lesser supply of working fluid into each of pin housing holes 41, 41 of fluid-communication control mechanisms 5, 5, and hence each of communication pins 42, 42 becomes held at its maximum advanced state (its original spring-loaded position). Thus, the annular groove 44 becomes brought into proper alignment with the communication groove 40 (see FIG. 6B). Accordingly, (i) fluid-communication between the second phase-retard chamber Re2 and the second phase-advance chamber Ad2 circumferentially adjacent to each other and (ii) fluid-communication between the fourth phase-retard chamber Re4 and the fourth phase-advance chamber Ad4 circumferentially adjacent to each other become established. As a result of this, regarding the plurality of vanes 21-24 of vane rotor 20, working fluid pressures act only on both the first vane 21 and the third vane 23.

Regarding the first vane 21 and the third vane 23, on which working fluid pressures act, the pressure-receiving surface area of the side face 21*a* of the first vane 21, facing the phase-advance chamber Ad1, and the pressure-receiving surface area of the side face 23*a* of the third vane 23, facing the phase-advance chamber Ad3, are dimensioned to be relatively greater than the pressure-receiving surface area of the side face 21*b* of the first vane 21, facing the phase-retard chamber Re1, and the pressure-receiving surface area of the side face 23*b* of the third vane 23, facing the phase-retard chamber Re3. By working fluid pressure acting on each of the side faces 21*a* and 23*a*, both facing the phase-advance-chamber side and having the relatively greater pressure-receiving surface area, the vane rotor 20 tends to rotate toward the phase-advance side. Thereafter, immediately when the predetermined intermediate angular position of vane rotor 20 has been reached, lock pins 32, 32 are brought into engagement with respective engagement holes 18, 18, and hence rotary motion of vane rotor 20 relative to housing 10 is restricted.

Subsequent to the above, when restarting the engine, the ignition switch is turned ON and thus oil pump 50 is driven. Therefore, working fluid (hydraulic pressure) is supplied to all the phase-retard chambers Re1-Re4, the phase-advance chambers Ad1-Ad4, the pressure-receiving chambers 35, 35 (exactly, the stepped portions 32*c*, 32*c* of lock pins 32, 32) of lock mechanisms 4, 4, and the pressure-receiving chambers 45, 45 (exactly, the stepped portions 42*c*, 42*c* of communication pins 42, 42) of fluid-communication control mechanisms 5, 5 via the electromagnetic directional control valve 55. After this, immediately when the engine speed exceeds a given engine revolution speed and hence a given engine operating condition has been reached, by virtue of the difference between the pressure-receiving surface area "Sr" (see FIG. 4) of the stepped portion 32*c* of lock pin 32 and the pressure-receiving surface area "St" (see FIG. 5) of the stepped portion 42*c* of communication pin 42, first, communication pin 42 begins to retreat. Immediately after the given axial position of the retreating communication pin 42 has been reached, fluid-communication between the communication hole 40 and the annular groove 44 becomes blocked by the outer periphery of large-diameter portion 42*a* of communication pin 42 (see FIG. 8B).

Thereafter, lock pin 32 begins to retreat with a proper time lag from the time when a transition (a mode shift) to a non-communication state (a blocked state) of communication hole 40 has occurred. In concert with an increase in retreating-movement of lock pin 32, lock pin 32 moves out of engagement with the engagement hole 18. The restriction on rotary motion of vane rotor 20 relative to housing 10 becomes released. That is, fluid-communication between the communication hole 40 and the annular groove 44 has already been blocked prior to the release of lock pin 32. Hence, vane rotor 20 can be accurately controlled to a given relative angular phase determined based on latest up-to-date information about the engine operating condition with hydraulic pressures (working fluid pressures) supplied to either phase-retard chambers Re1-Re4 or phase-advance chambers Ad1-Ad4.

As appreciated from the above, according to the VTC apparatus of the first embodiment, in an engine stopped state where oil pump 50 has stopped and thus there is no supply of lock-to-unlock switching pressure to each of lock mechanisms 4, 4 and there is no supply of communication-to-non-communication switching pressure to each of fluid-communication control mechanisms (FCCM) 5, 5, (i) fluid-communication between the two adjacent hydraulic chambers (i.e., the second phase-retard chamber Re2 and the second phase-advance chamber Ad2) partitioned by the second vane and (ii) fluid-communication between the two adjacent hydraulic chambers (i.e., the fourth phase-retard chamber Re4 and the fourth phase-advance chamber Ad4) partitioned by the fourth vane 24 are established by means of the respective FCCMs 5, 5. Hence, by virtue of the pressure-receiving surface area difference of side faces 21*a*-21*b* of the first vane 21 and the pressure-receiving surface area difference of side faces 23*a*-23*b* of the third vane 23, which vanes are the other vanes, namely, non-FCCM equipped vanes, vane rotor 20 can be biased or displaced in a specified rotation direction (in a phase-advance direction in the first embodiment). Thus, during the engine stopping period, it is possible to more rapidly move the vane rotor 20 toward the predetermined intermediate angular position (the lock position), regardless of whether the engine is cold or warm.

Furthermore, the VTC apparatus of the first embodiment is configured such that, immediately after the engine has been restarted, a transition (a mode shift) to a non-communication state (a blocked state) of communication hole 40 occurs prior to the release of restriction on rotary motion of vane rotor 20 relative to housing 10, restricted by means of the lock mechanisms 4, 4. Therefore, it is possible to ensure or permit a more rapid rotary motion of vane rotor 20 towards the predetermined intermediate angular position (the lock position) by virtue of the pressure-receiving surface area difference of side faces 21*a*-21*b* of the first vane 21 and the pressure-receiving surface area difference of side faces 23*a*-23*b* of the third vane 23, in other words, due to the unbalanced pressure-receiving surface area configuration of the first vane 21 and the third vane 23, when restarting the engine from its stopped state. Additionally, after the engine has been restarted, with communication holes 40, 40 blocked in advance and lock pins 32 disengaged (released) with a proper time lag from a transition to a non-communication state (a blocked state) of each of communication holes 40, 40, it is possible to ensure a good phase-control responsiveness of vane rotor 20 by applying an appropriately controlled hydraulic pressure to each of vanes 21-24 with hydraulic pressures (working fluid pressures) supplied to either phase-retard chambers Re1-Re4 or phase-advance chambers Ad1-Ad4.

Figure 9:
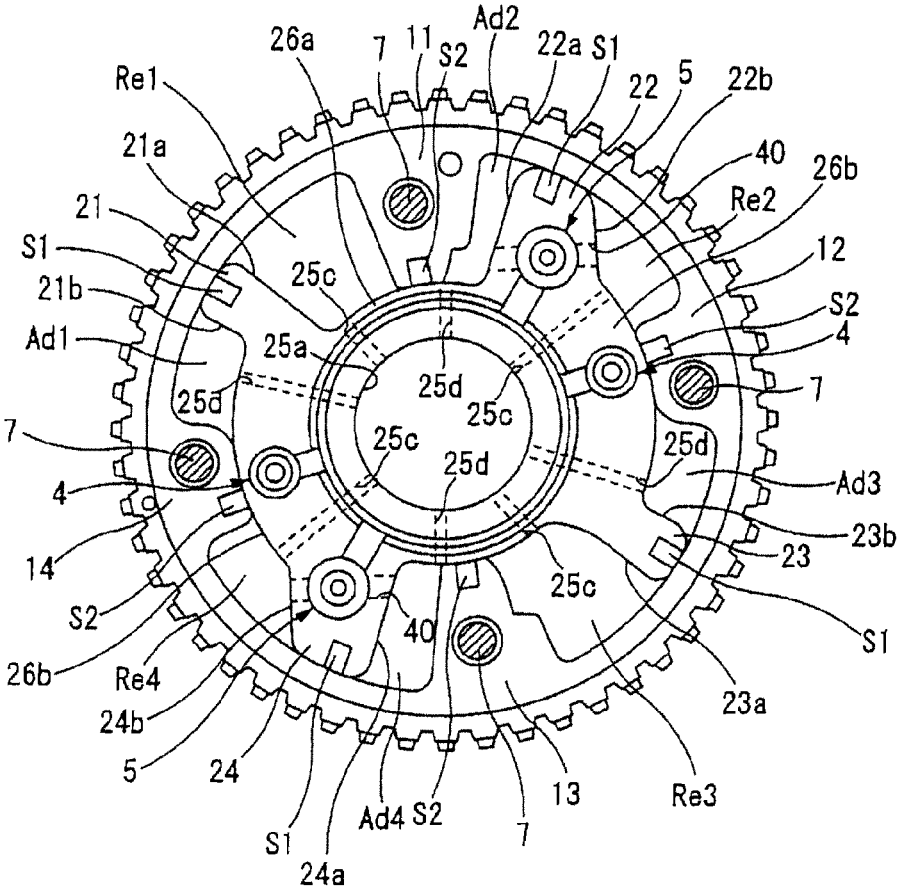
FIG. 9 is a lateral cross-sectional view of a modification to the hydraulically-operated four-vane equipped VTC apparatus of the first embodiment shown in FIG. 3.

By the way, in the VTC apparatus of the first embodiment shown in FIGS. 1-8B, the cross sectional shape of each of vanes 21-24 and the layout of each of fluid-communication control mechanisms 5, 5 are configured such that vane rotor 20 rotates toward the phase-advance side when restarting the engine from its stopped state. In lieu thereof, as seen from the lateral cross section of the modification of FIG. 9, modified from the hydraulically-operated four-vane equipped VTC apparatus of the first embodiment, the first vane 21 (not equipped with the fluid-communication control mechanism 5) and the third vane 23 (not equipped with the fluid-communication control mechanism 5) may be configured such that the summed value of the pressure-receiving surface area of the side face 21*b* of the first vane 21, facing the first phase-advance chamber Ad1, and the pressure-receiving surface area of the side face 23*b* of the third vane 23, facing the third phase-advance chamber Ad3, is set to be less than the summed value of the pressure-receiving surface area of the side face 21*a* of the first vane 21, facing the first phase-retard chamber Re1, and the pressure-receiving surface area of the side face 23*a* of the third vane 23, facing the third phase-retard chamber Re3. In contrast, the second vane 22 (equipped with the fluid-communication control mechanism (FCCM) 5) and the fourth vane 24 (equipped with the fluid-communication control mechanism (FCCM) 5) may be configured such that the summed value of the pressure-receiving surface area of the side face 22*a* of the second vane 22, facing the second phase-advance chamber Ad2, and the pressure-receiving surface area of the side face 24*a* of the fourth vane 24, facing the fourth phase-advance chamber Ad4, is set greater than the summed value of the pressure-receiving surface area of the side face 22*b* of the second vane 22, facing the second phase-retard chamber Re2, and the pressure-receiving surface area of the side face 24*b* of the fourth vane 24, facing the fourth phase-retard chamber Re4. With the configurations of the non-FCCM equipped vanes 21 and 23 and FCCM-equipped vanes 22 and 24 of the modification of FIG. 9, the VTC apparatus of the modification is designed such that vane rotor 20 rotates toward the phase-retard side when restarting the engine from its stopped state. An appropriate one of these two different types of VTC apparatus of the first embodiment (see FIGS. 1-8B) and the modification (FIG. 9) can be freely selected depending on the specification of engine installed or mounted.

[Second Embodiment]

Figure 10:
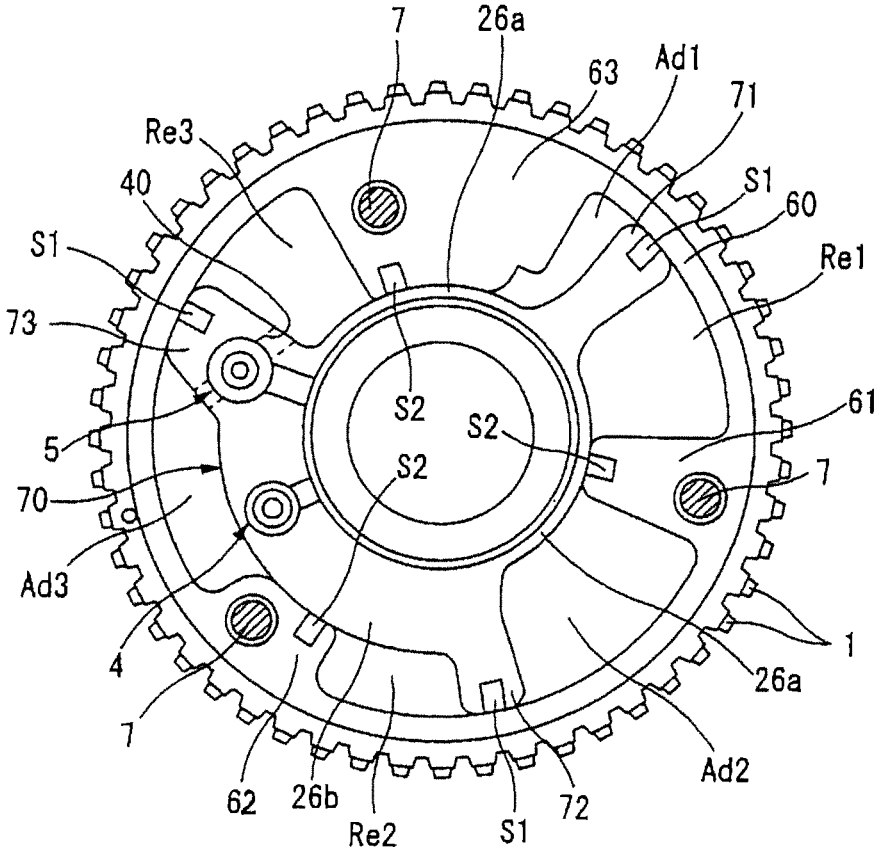
FIG. 10 is a lateral cross-sectional view of a hydraulically-operated three-vane equipped VTC apparatus of the second embodiment according to the invention.

Referring now to FIG. 10, there is shown the internal combustion engine VTC apparatus of the second embodiment. The second embodiment slightly differs from the first embodiment, in that the VTC apparatus of the second embodiment is a hydraulically-operated three-vane equipped VTC apparatus. In the first embodiment, housing 10 has four shoes 11-14 and the rotor main body 25 of vane rotor 20 is formed integral with four vanes 21-24. In contrast, in the second embodiment, a housing 60 has three shoes 61-63, while a vane rotor 70 has three vanes 71-73. The other configuration of the VTC apparatus of the second embodiment (FIG. 10) is similar to that of the first embodiment (FIGS. 1-8B). In explaining the second embodiment, for the purpose of simplification of the disclosure, the same reference signs used to designate elements in the first embodiment will be applied to the corresponding elements used in the second embodiment, while detailed description of the same reference signs will be omitted because the above description seems to be self-explanatory.

As clearly seen from the cross section of FIG. 10, in the second embodiment, housing 60 has the three shoes, namely a first shoe 61, a second shoe 62, and a third shoe 63 formed integral with the sprocket 1 and configured to protrude radially inward from the inner periphery of housing 60. The rotor main body of vane rotor 70 is formed integral with the three vanes, namely a first vane 71, a second vane 72, and a third vane 73 integral with the outer periphery of the rotor main body and configured to protrude radially outward from the outer periphery of vane rotor 70 and almost equidistantly-spaced from each other in the circumferential direction. The first vane 71 is configured to be substantially conformable to the internal space defined between the third shoe 63 and the first shoe 61. The second vane 72 is configured to be substantially conformable to the internal space defined between the first shoe 61 and the second shoe 62. The third vane 73 is configured to be substantially conformable to the internal space defined between the second shoe 62 and the third shoe 63. The circumference of the rotor main body of vane rotor 70 defined between the second vane 72 and the third vane 73 is formed as a comparatively thick-walled single large-diameter portion 26*b*. The circumference of the rotor main body of vane rotor 70 defined between the third vane 73 and the first vane 71 is formed as a comparatively thin-walled small-diameter portion 26*a*. The circumference of the rotor main body of vane rotor 70 defined between the first vane 71 and the second vane 72 is formed as a comparatively thin-walled small-diameter portion 26*a*. The lock mechanism 4 is arranged substantially at a middle of the single large-diameter portion 26*b*. The fluid-communication control mechanism 5 is provided at the third vane 73. By the way, as appreciated from the cross section of FIG. 10, there is no difference between the pressure-receiving surface areas of side faces of the first vane 71. In contrast, there is a difference between the pressure-receiving surface areas of side faces of the second vane 72.

With the previously-discussed deformed configuration of the rotor main body of vane rotor 70, in the VTC apparatus of the second embodiment, during an engine stopping period the third phase-retard chamber Re3 and the third phase-advance chamber Ad3, partitioned by the third vane 73, are communicated with each other through the communication hole 40 with the communication pin 42 held at its maximum advanced state (i.e., its original spring-loaded position). Hence, when starting the engine from its stopped state, due to the unbalanced pressure-receiving surface area configuration of the second vane 72 not equipped with the fluid-communication control mechanism 5, vane rotor 70 can be biased or displaced in a specified phase-change direction. Accordingly, the VTC apparatus of the second embodiment can provide the same operation and effects as the first embodiment.

As can be appreciated from the above, in the first embodiment two fluid-communication control mechanisms (FCCMs) 5, 5 are provided, whereas in the second embodiment only one fluid-communication control mechanism (FCCM) 5 is provided. That is, under a specified condition where at least one FCCM-equipped vane and at least one non-FCCM equipped vane, which is the same number as the at least one FCCM-equipped vane and has an unbalanced pressure-receiving surface area configuration, are provided, the same operation and effects as the first embodiment can be provided.

It will be appreciated that the invention is not limited to the particular embodiments shown and described herein, but that various changes and modifications may be made. For instance, regarding both the lock mechanism 4 and the hydraulic-pressure supply-discharge mechanism 6, except the fluid-communication control mechanism 5 that constructs an essential part of the invention, concrete system configurations of these two mechanisms 4 and 6 may be properly changed or altered freely depending on the type, specification and/or manufacturing costs of an internal combustion engine to which the VTC apparatus of the invention can be applied.

The entire contents of Japanese Patent Application No. 2014-192077 (filed Sep. 22, 2014) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A valve timing control apparatus of an internal combustion engine, comprising:

a housing adapted to be driven by torque transmitted from a crankshaft and having a plurality of shoes formed to protrude radially inward from an inner periphery of the housing for partitioning an internal space into a plurality of working chambers;

a vane rotor having a rotor configured to rotate relatively to the housing and a plurality of vanes fixedly connected to a camshaft together with the rotor and formed to protrude radially outward from an outer periphery of the rotor for partitioning each of the plurality of the working chambers into a phase-retard chamber and a phase-advance chamber in cooperation with the plurality of shoes;

a lock mechanism interposed between the vane rotor and the housing for restricting rotary motion of the vane rotor relative to the housing depending on an engine operating condition; and a fluid-communication control mechanism (FCCM) formed in at least one of the plurality of vanes so as to form at least one FCCM-equipped vane, wherein the FCCM comprises a communication hole which permits fluid-communication between the phase-retard chamber and the phase-advance chamber defined by the at least one FCCM-equipped vane, and the FCCM is further configured to enable switching between a communication state and a non-communication state of the communication hole, wherein at least one of the plurality of vanes is configured without a FCCM so as to form at least one non-FCCM equipped vane, wherein the at least one non-FCCM equipped vane is configured such that a summed pressure-receiving surface area on a first side, facing the phase-retard chamber, and a summed pressure-receiving surface area on a second side, facing the phase-advance chamber, are set to differ from each other.

2. The valve timing control apparatus as recited in claim 1, wherein:

the rotor has a large-diameter portion and a small-diameter portion; and the plurality of vanes are formed to protrude radially outward from an outer periphery of the large-diameter portion of the rotor.

3. The valve timing control apparatus as recited in claim 2, wherein:

the FCCM has a hydraulically-operated valve element for controlling switching between the communication state of the communication hole and the non-communication state of the communication hole by changing a flow-path cross-sectional area of the communication hole.

4. The valve timing control apparatus as recited in claim 3, wherein:

the FCCM is formed radially inside of the at least one FCCM-equipped vane.

5. The valve timing control apparatus as recited in claim 4, wherein:

one of two opening ends of the communication hole of the at least one FCCM-equipped vane, facing the small-diameter portion of the rotor, is arranged radially inside of the other of the two opening ends of the communication hole of the at least one FCCM-equipped vane, facing the large-diameter portion of the rotor.

6. The valve timing control apparatus as recited in claim 5, wherein:

the at least one FCCM-equipped vane is configured such that an angle between a side face of the at least one FCCM-equipped vane, facing the large-diameter portion of the rotor, and a tangential line of the side face tangent to an outer peripheral surface of the large-diameter portion is an obtuse angle.

7. The valve timing control apparatus as recited in claim 3, wherein:

the hydraulically-operated valve element has an annular groove formed in an outer peripheral surface of the valve element for changing the flow-path cross-sectional area of the communication hole by changing an opening area of the annular groove opened into the communication hole.

8. The valve timing control apparatus as recited in claim 3, wherein:

the FCCM is configured such that hydraulic pressure acts on one end of the valve element and a biasing force of a spring acts on the other end of the valve element; and the FCCM is further configured such that the flow-path cross-sectional area of the communication hole reduces by movement of the valve element against the biasing force of the spring depending on a level of the hydraulic pressure.

9. The valve timing control apparatus as recited in claim 2, wherein:

the at least one non-FCCM equipped vane is configured such that the summed pressure-receiving surface area on the second side, facing the phase-advance chamber, is dimensioned to be greater than the summed pressure-receiving surface area on the first side, facing the phase-retard chamber.

10. The valve timing control apparatus as recited in claim 9, wherein:

the at least one FCCM-equipped vane is configured such that a summed pressure-receiving surface area on a first side, facing the phase-advance chamber, is dimensioned to be less than a summed pressure-receiving surface area on a second side, facing the phase-retard chamber.

11. The valve timing control apparatus as recited in claim 10, wherein:

the plurality of vanes are configured as an even number of vanes equidistantly-spaced from each other in a circumferential direction of the rotor; and the at least one FCCM-equipped vane includes an even number of FCCM-equipped vanes arranged to be diametrically opposed to each other with respect to a rotation center of the rotor.

12. The valve timing control apparatus as recited in claim 2, wherein:

the at least one non-FCCM equipped vane is configured such that the summed pressure-receiving surface area on the second side, facing the phase-advance chamber, is dimensioned to be less than the summed pressure-receiving surface area on the first side, facing the phase-retard chamber.

13. The valve timing control apparatus as recited in claim 12, wherein:

the at least one FCCM-equipped vane is configured such that a summed pressure-receiving surface area on a first side, facing the phase-advance chamber, is dimensioned to be greater than a summed pressure-receiving surface area on a second side, facing the phase-retard chamber.

14. The valve timing control apparatus as recited in claim 13, wherein:

the plurality of vanes are configured as an even number of vanes equidistantly-spaced from each other in a circumferential direction of the rotor; and the at least one FCCM-equipped vane includes an even number of FCCM-equipped vanes arranged to be diametrically opposed to each other with respect to a rotation center of the rotor.

15. The valve timing control apparatus as recited in claim 2, wherein:

the lock mechanism is installed in the large-diameter portion of the rotor.

16. The valve timing control apparatus as recited in claim 15, wherein:

the lock mechanism has a housing hole formed in the large-diameter portion of the rotor, a lock member slidably accommodated in the housing hole, and a lock recessed groove formed in the housing and configured to permit the lock member to be brought into engagement with the lock recessed groove.

17. A valve timing control apparatus of an internal combustion engine, comprising:

a housing adapted to be driven by torque transmitted from a crankshaft and having a plurality of shoes formed to protrude radially inward from an inner periphery of the housing for partitioning an internal space into a plurality of working chambers;

a vane rotor having a rotor configured to rotate relatively to the housing and a plurality of vanes fixedly connected to a camshaft together with the rotor and formed to protrude radially outward from an outer periphery of the rotor for partitioning each of the plurality of working chambers into a phase-retard chamber and a phase-advance chamber in cooperation with the plurality of shoes;

a housing hole formed in the vane rotor;

a lock member slidably accommodated in the housing hole;

a lock recessed groove formed in the housing and configured to permit the lock member to be brought into engagement with the lock recessed groove;

a spring provided to apply a biasing force to the lock member for permanently biasing the lock member toward the lock recessed groove;

a lock mechanism passage configured to supply hydraulic pressure to the lock member for movement of the lock member out of engagement with the lock recessed groove; and a fluid-communication control mechanism (FCCM) provided in at least one of the plurality of vanes so as to form at least one FCCM-equipped vane, the FCCM configured to enable switching between a fluid-communication established state and a fluid-communication blocked state of the phase-retard chamber and the phase-advance chamber defined by the at least one FCCM-equipped vane, wherein at least one of the plurality of vanes is configured without a FCCM so as to form at least one non-FCCM equipped vane, wherein the at least one non-FCCM equipped vane is configured such that a summed pressure-receiving surface area on a first side, facing the phase-retard chamber, and a summed pressure-receiving surface area on a second side, facing the phase-advance chamber, are set to differ from each other.

18. The valve timing control apparatus as recited in claim 17, wherein:

the FCCM has a valve element operated by a predetermined supply hydraulic pressure for controlling mode-switching from the fluid-communication established state to the fluid-communication blocked state by reducing a flow-path cross-sectional area of a communication hole formed in the at least one FCCM-equipped vane by means of the valve element.

19. The valve timing control apparatus as recited in claim 17, wherein:

the FCCM is configured to create the fluid-communication established state, when starting the engine from a stopped state.

20. The valve timing control apparatus as recited in claim 19, wherein:

the FCCM is configured to create the fluid-communication blocked state, when an engine speed exceeds a given engine revolution speed after the engine has been started.

* * * * *